US011761193B2

(12) United States Patent
Soivio

(10) Patent No.: US 11,761,193 B2
(45) Date of Patent: Sep. 19, 2023

(54) STEEL BEAM AND SUPPORTING ARRANGEMENT FOR SUPPORTING A STEEL BEAM AT A CONSOLE

(71) Applicant: PEIKKO GROUP OY, Lahti (FI)

(72) Inventor: Jaakko Soivio, Lahti (FI)

(73) Assignee: PEIKKO GROUP OY, Lahti (FI)

( * ) Notice: Subject to any disclaimer, the term of this patent is extended or adjusted under 35 U.S.C. 154(b) by 304 days.

(21) Appl. No.: 17/296,864

(22) PCT Filed: Nov. 27, 2019

(86) PCT No.: PCT/FI2019/050844

§ 371 (c)(1),
(2) Date: May 25, 2021

(87) PCT Pub. No.: WO2020/109662

PCT Pub. Date: Jun. 4, 2020

(65) Prior Publication Data

US 2022/0025636 A1 Jan. 27, 2022

(30) Foreign Application Priority Data

Nov. 29, 2018 (FI) ..... 20186015

(51) Int. Cl.
*E04B 1/21* (2006.01)
*E04B 1/24* (2006.01)
(Continued)

(52) U.S. Cl.
CPC ..... *E04B 1/215* (2013.01); *E04B 1/2403* (2013.01); *E04C 3/291* (2013.01); *E04C 3/293* (2013.01);
(Continued)

(58) Field of Classification Search
CPC ..... E04B 1/215; E04B 1/2403; E04B 2001/2412; E04B 2001/2415;
(Continued)

(56) References Cited

U.S. PATENT DOCUMENTS 64,654 A * 5/1867 Floyd ..... H01B 17/02 403/375
563,722 A * 7/1896 Scott ..... F16B 9/09 403/246
(Continued)

FOREIGN PATENT DOCUMENTS

EP 0 843 053 A1 5/1998
ES 2 220 236 A1 12/2004
(Continued)

OTHER PUBLICATIONS

Jul. 1, 2019 Search Report issued in Finnish Patent Application No. 20186015.
(Continued)

*Primary Examiner* — Brian E Glessner
*Assistant Examiner* — Adam G Barlow
(74) *Attorney, Agent, or Firm* — Oliff PLC

(57) ABSTRACT

A steel beam and a supporting arrangement for supporting a steel beam at console, the steel beam including a base plate, two web parts, and an end plate at each end of the steel beam. The base plate, the two web parts and the end plates delimit a space. At least one of the ends of the steel beam includes a console supporting slot extending from the at least one end of the steel beam. The console supporting slot is laterally at least partly limited by side plates inside the space of the steel beam, and by the side plates are attached to the end plate and to the base plate.

25 Claims, 17 Drawing Sheets

(51) Int. Cl.
*E04C 3/29* (2006.01)
*E04C 3/293* (2006.01)

(52) U.S. Cl.
CPC ..... *E04B 2001/2412* (2013.01); *E04B 2001/2415* (2013.01)

(58) Field of Classification Search
CPC .... E04B 2001/2409; E04B 5/29; E04C 3/291; E04C 3/293; E04C 3/07
See application file for complete search history.

(56) References Cited

U.S. PATENT DOCUMENTS 568,397 A * 9/1896 Birely ..... F16B 9/09 403/244
583,685 A * 6/1897 Jackson ..... E04B 5/40 52/836
687,114 A * 11/1901 Brown et al. ..... B62D 27/023 403/219
2,258,858 A * 10/1941 Meadowcroft ..... E04C 2/322 428/603
2,992,711 A * 7/1961 Mitchell ..... E04C 2/3405 52/798.1
3,168,793 A * 2/1965 Gibson ..... E04G 1/14 403/175
3,685,866 A * 8/1972 Patenaude ..... F16B 9/09 403/189
4,186,535 A * 2/1980 Morton ..... E04B 1/98 52/250
4,258,464 A * 3/1981 Ullman, Jr. ..... A47B 57/22 403/353
4,333,280 A * 6/1982 Morton ..... E04B 1/98 52/250
4,335,557 A * 6/1982 Morton ..... E04B 1/164 52/250
4,436,342 A * 3/1984 Nilson ..... F16B 12/20 297/440.22
4,715,075 A * 12/1987 Shamie ..... A47D 7/01 5/99.1
4,894,967 A * 1/1990 Morton ..... E04D 3/3607 52/630
5,205,098 A * 4/1993 Landis ..... E04C 3/07 52/336
5,433,051 A * 7/1995 Johansson ..... E04F 21/05 52/367
2003/0041549 A1* 3/2003 Simmons ..... E04B 1/2403 52/655.1
2005/0072107 A1* 4/2005 Kebeli ..... E04C 3/07 52/836
2008/0107480 A1* 5/2008 Berg ..... E04B 1/215 403/293
2008/0279620 A1* 11/2008 Berg ..... F16B 7/042 403/178
2012/0233961 A1* 9/2012 Matos ..... E04C 3/07 52/846
2014/0331498 A1* 11/2014 Matos ..... E04C 3/07 29/897.35
2015/0308475 A1* 10/2015 Yu Hsiang ..... F16B 7/0473 403/381
2016/0245320 A1* 8/2016 Oetlinger ..... E05D 5/0238
2017/0226731 A1* 8/2017 Chamberlain ..... E04B 5/40
2018/0245329 A1* 8/2018 Yu ..... E04B 1/2403
2020/0354965 A1* 11/2020 Attebery, II ..... B32B 3/266
2022/0049490 A1* 2/2022 Soivio ..... E04B 1/30

FOREIGN PATENT DOCUMENTS

FI 127570 B 9/2018
FR 2 359 302 A1 2/1978
NL 2000955 C1 4/2009
WO 88/08061 A1 10/1988
WO 02/33185 A1 4/2002
WO 2004/031498 A1 4/2004

OTHER PUBLICATIONS

Jan. 31, 2020 Search Report issued in International Patent Application No. PCT/FI2019/050844.

Figure 19:
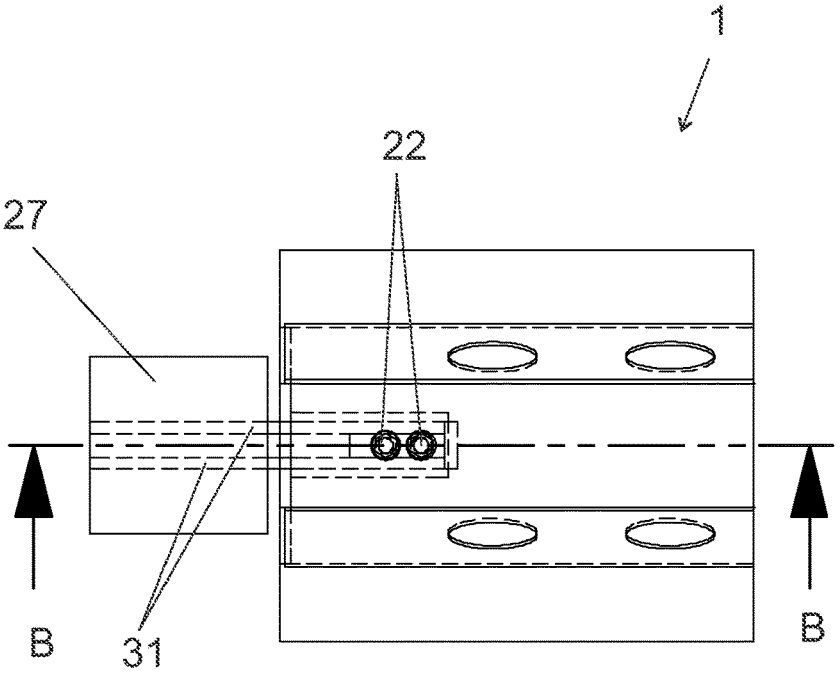

* cited by examiner (B-B FIG 19)

STEEL BEAM AND SUPPORTING ARRANGEMENT FOR SUPPORTING A STEEL BEAM AT A CONSOLE

FIELD OF THE INVENTION

The invention relates to a steel beam as defined in the preamble of independent claim 1.

The invention also relates to a supporting arrangement for supporting a steel beam at a console as defined in the preamble of independent claim 12.

Publication WO 02/33185 presents a bracket for supporting a structural element to a support structure.

OBJECTIVE

The object of the invention is to provide a steel beam and a supporting arrangement for supporting a steel beam at a console which steel beam and supporting arrangement have an increased capacity of transferring horizontal loads and forces between the steel beam and a console that an end of the steel beam is supported on. The console can for example be configured to be arranged at a column of a building.

SHORT DESCRIPTION

The steel beam of the invention is characterized by the definitions of independent claim 1.

Preferred embodiments of the steel beam are defined in the dependent claims 2 to 11.

The supporting arrangement of the invention is correspondingly characterized by the definitions of independent claim 12.

Preferred embodiments of the supporting arrangement are defined in the dependent claims 13 to 25.

LIST OF FIGURES

Figure 1:
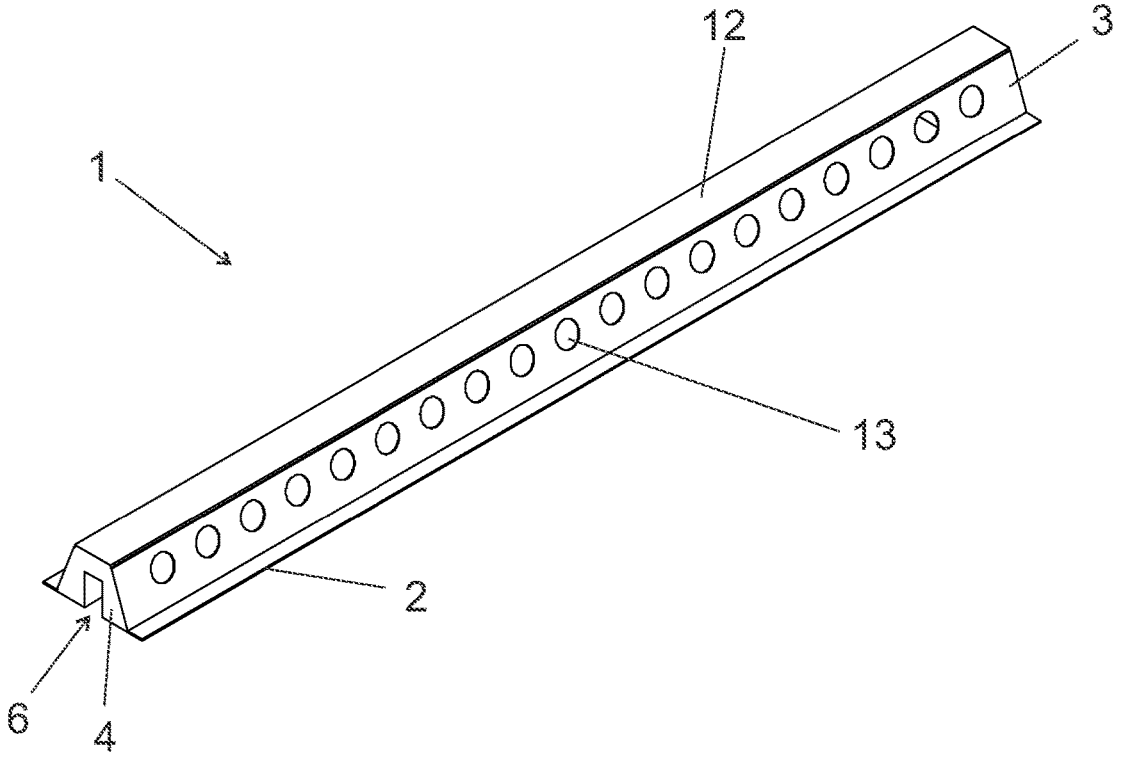
Figure 2:
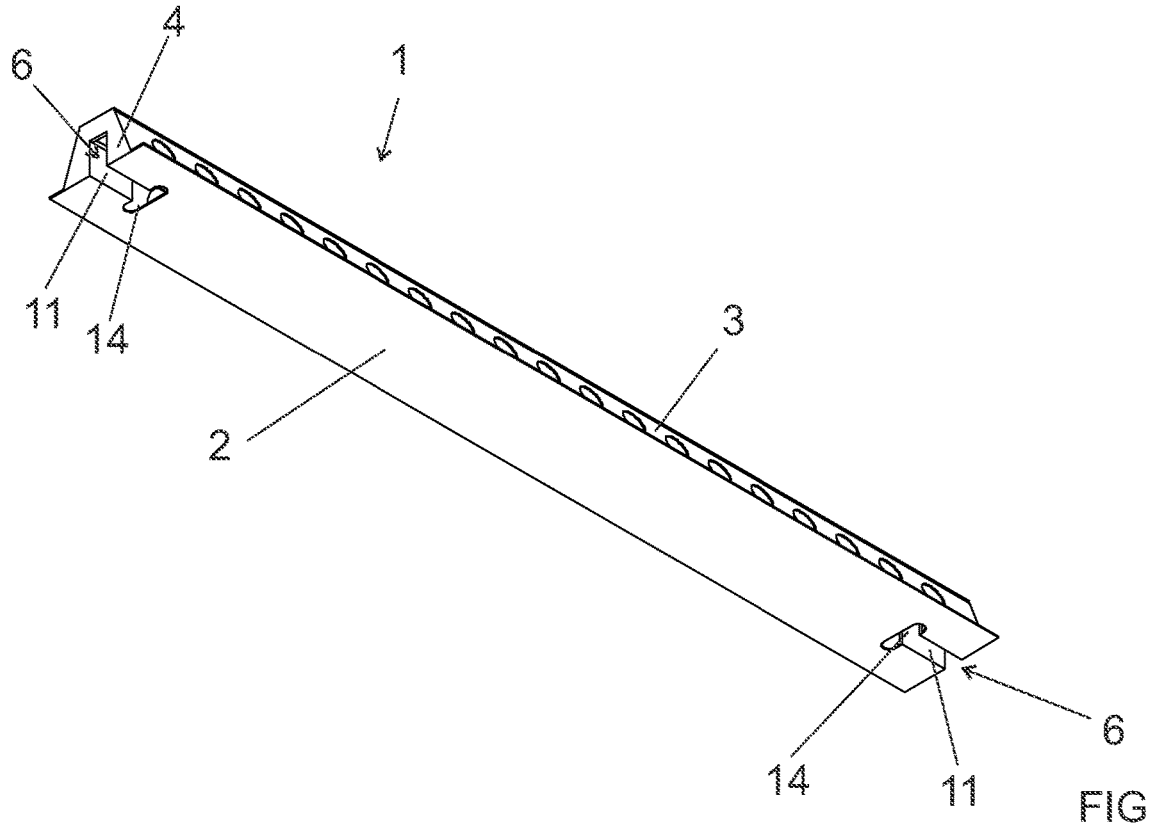
Figure 3:
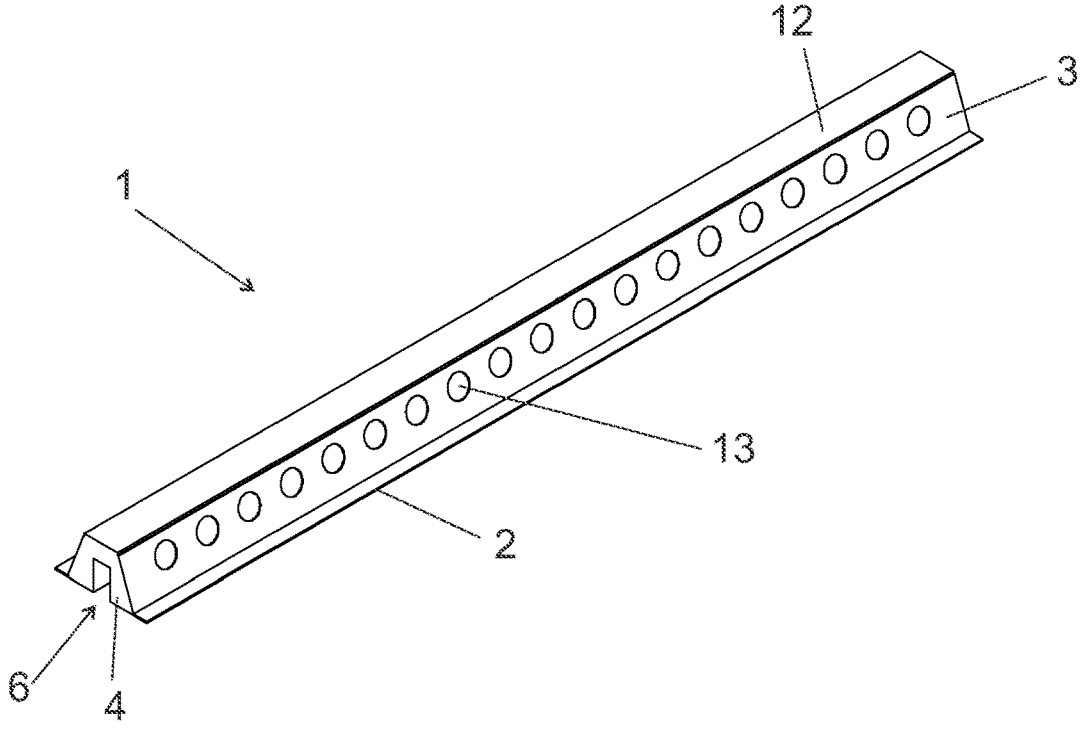
Figure 4:
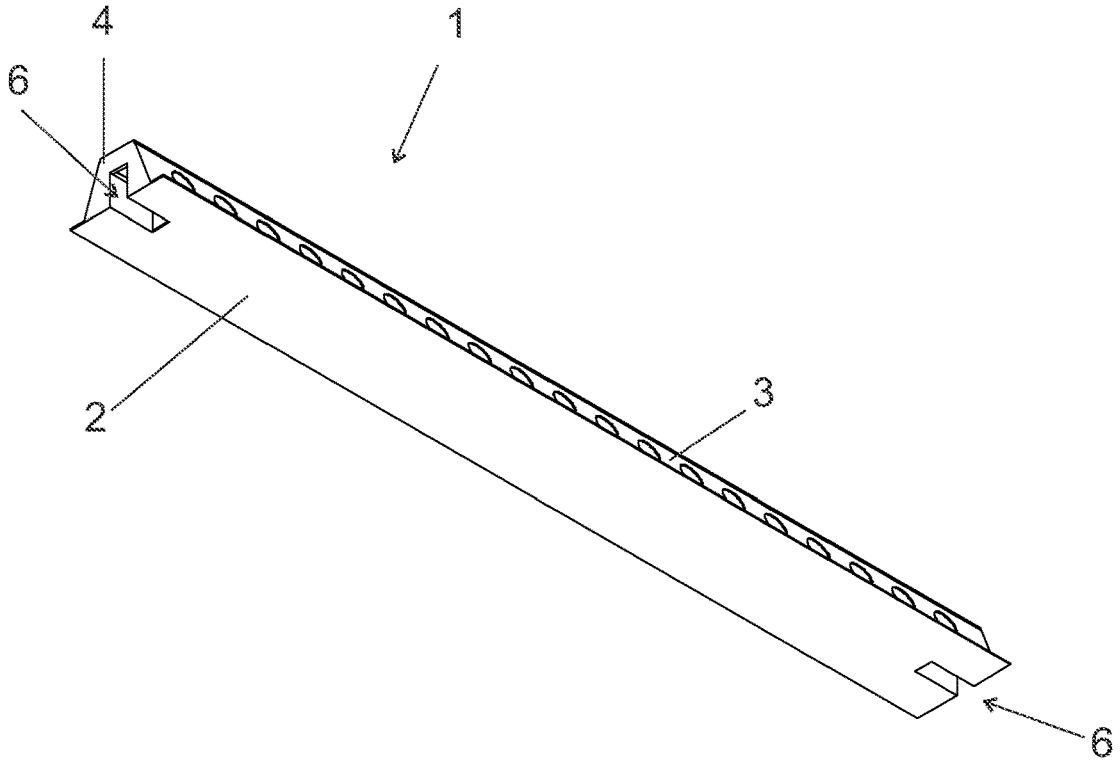
Figure 5:
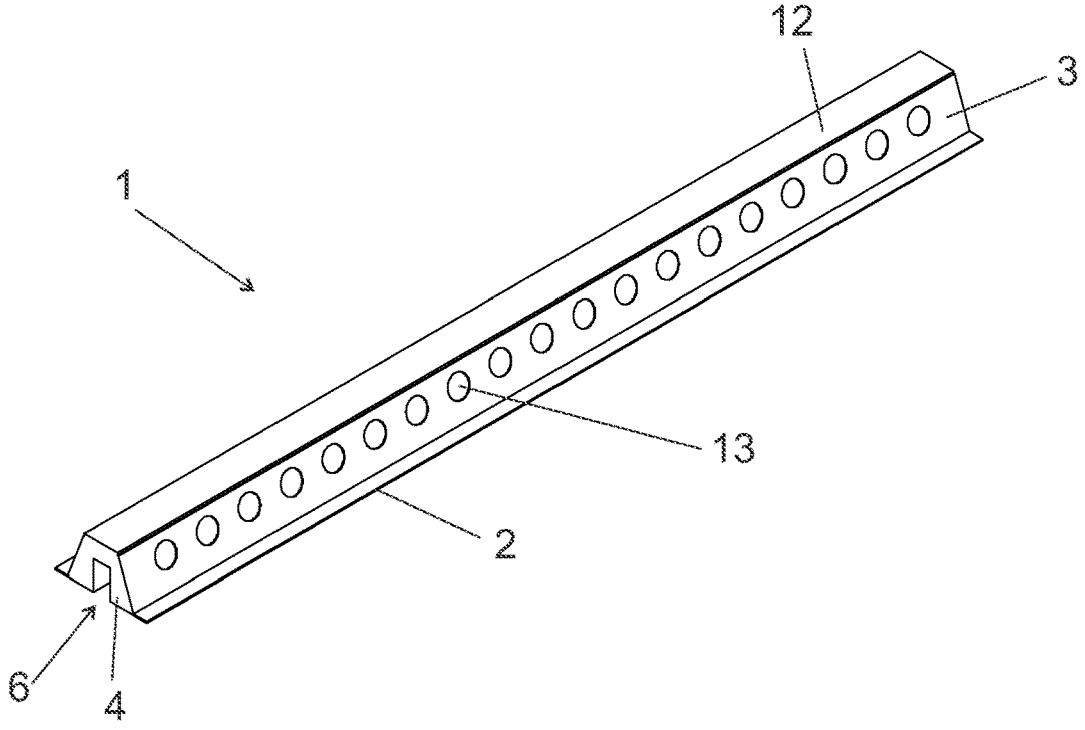
Figure 6:
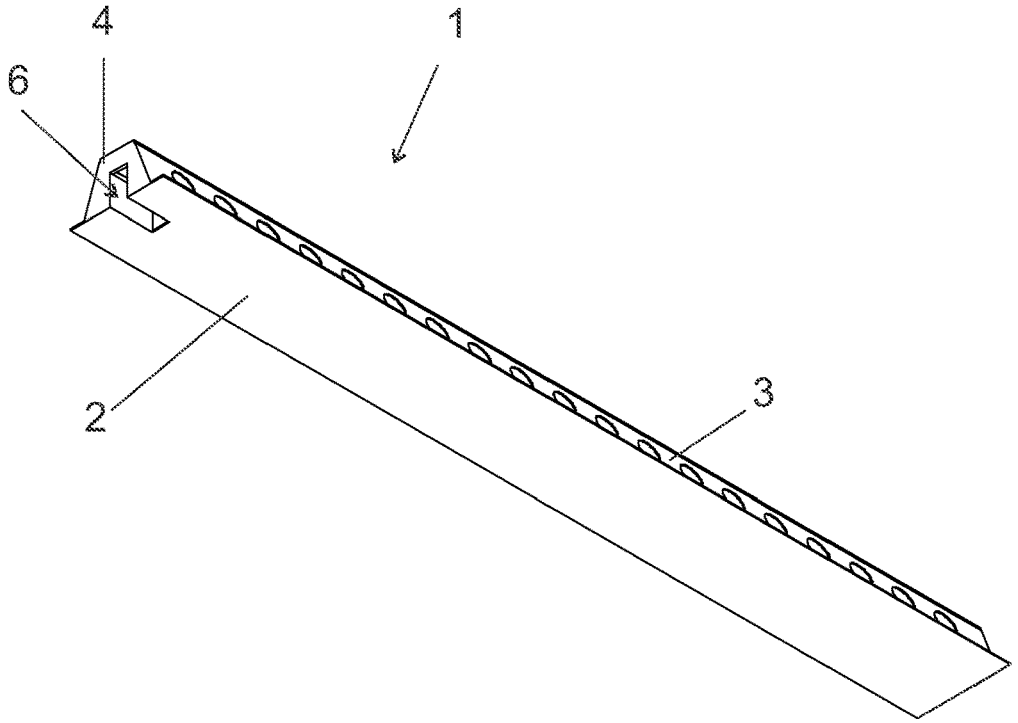
Figure 7:
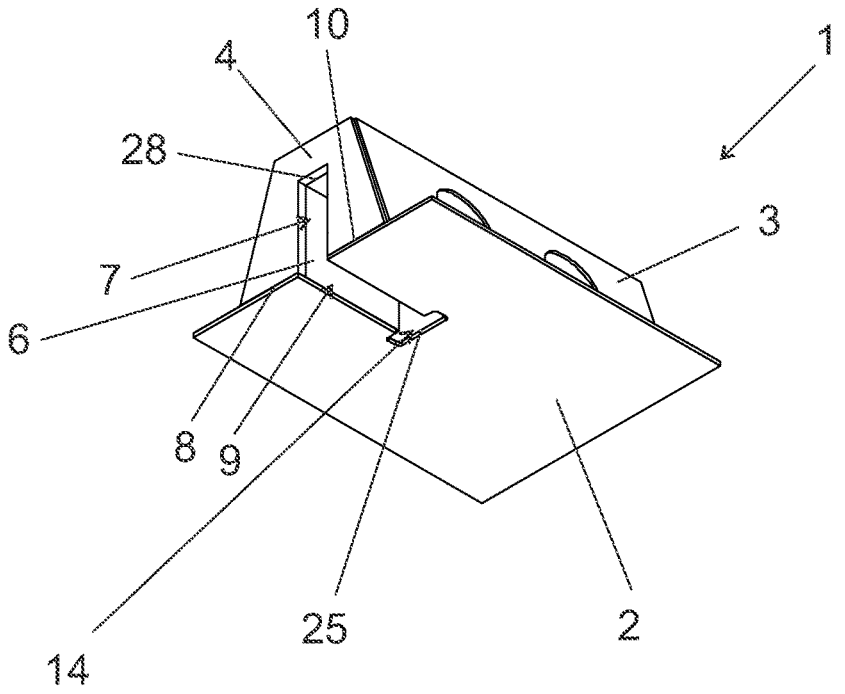
Figure 8:
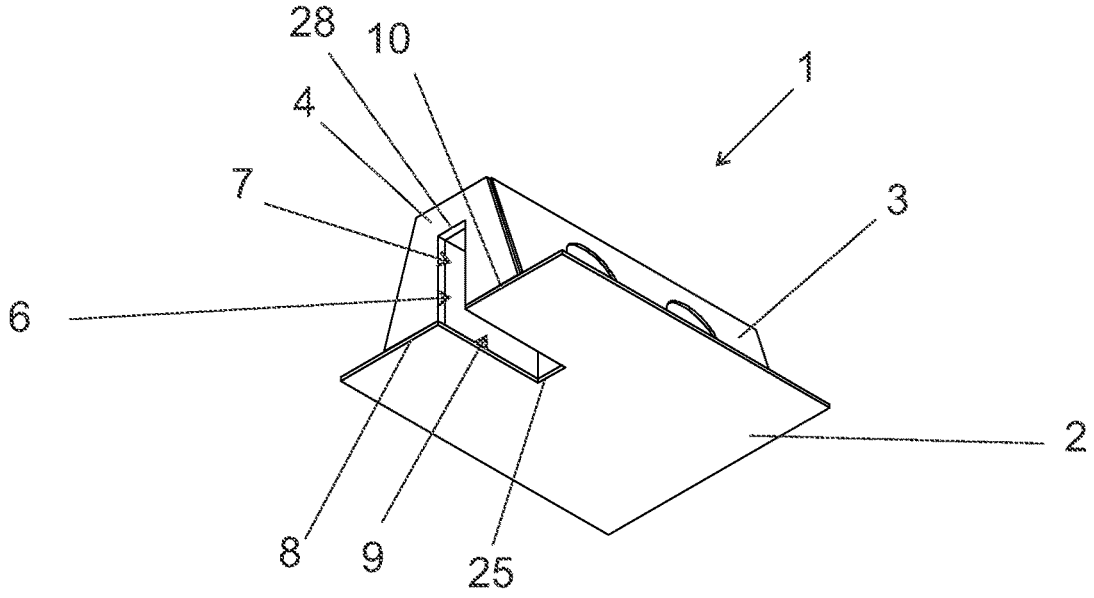
Figure 9:
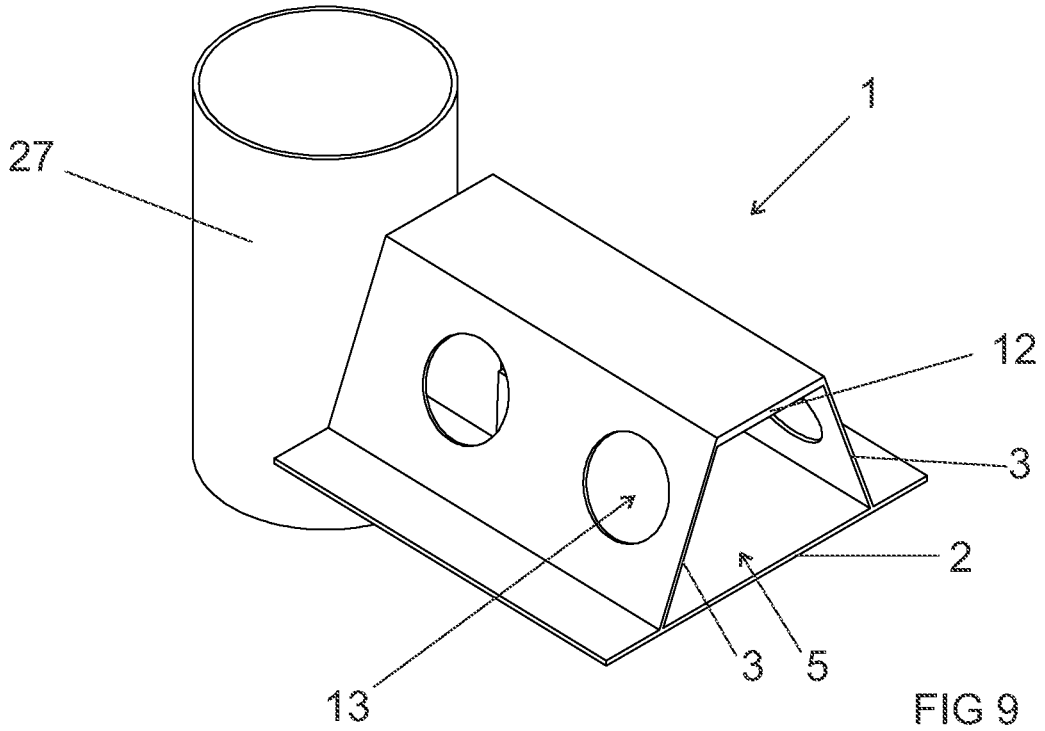
Figure 10:
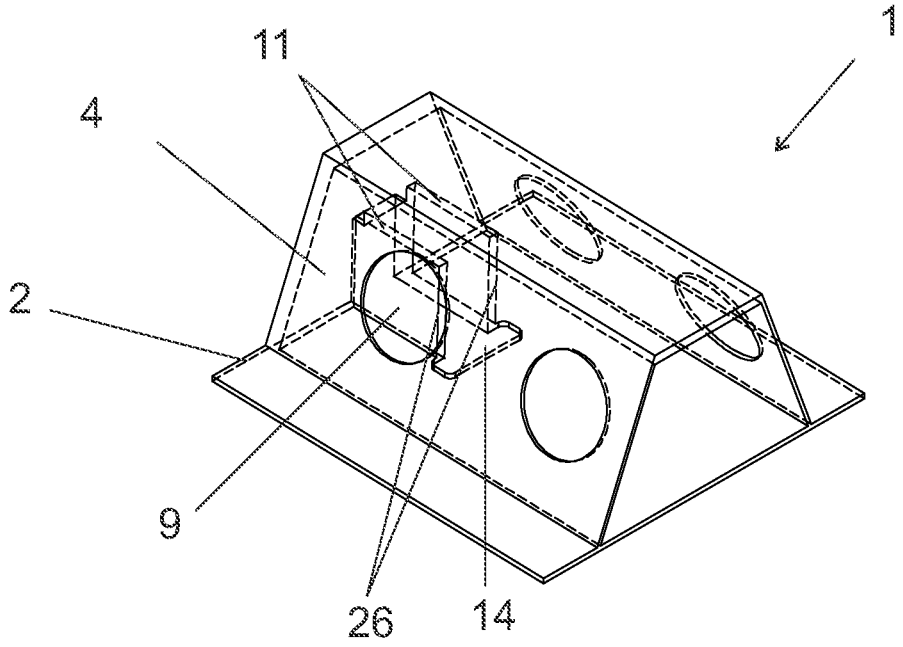
Figure 11:
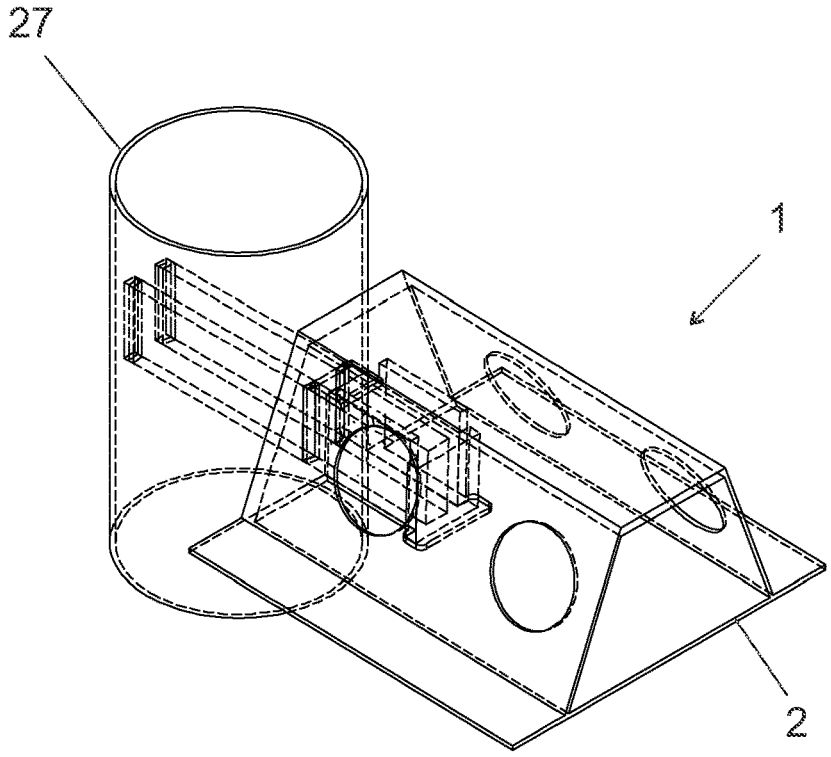
Figure 12:
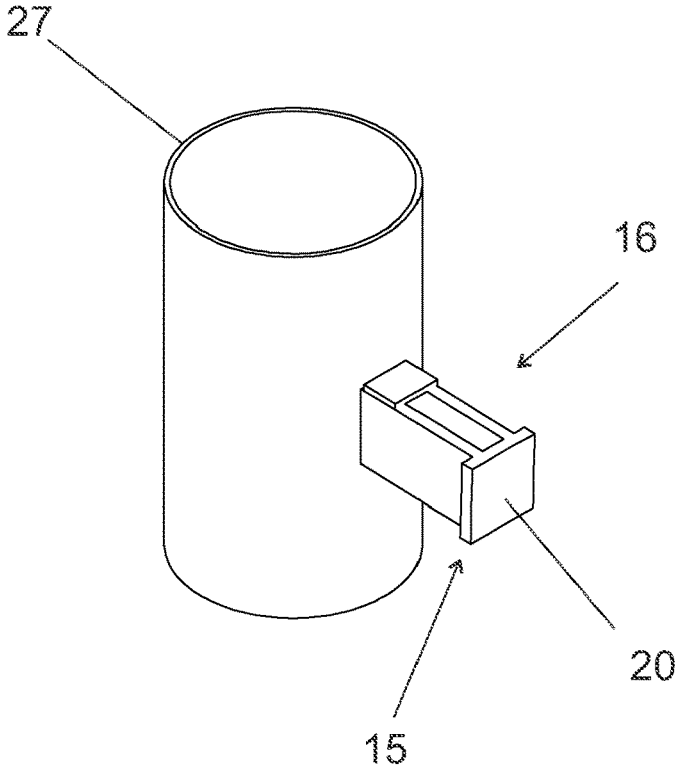
Figure 13:
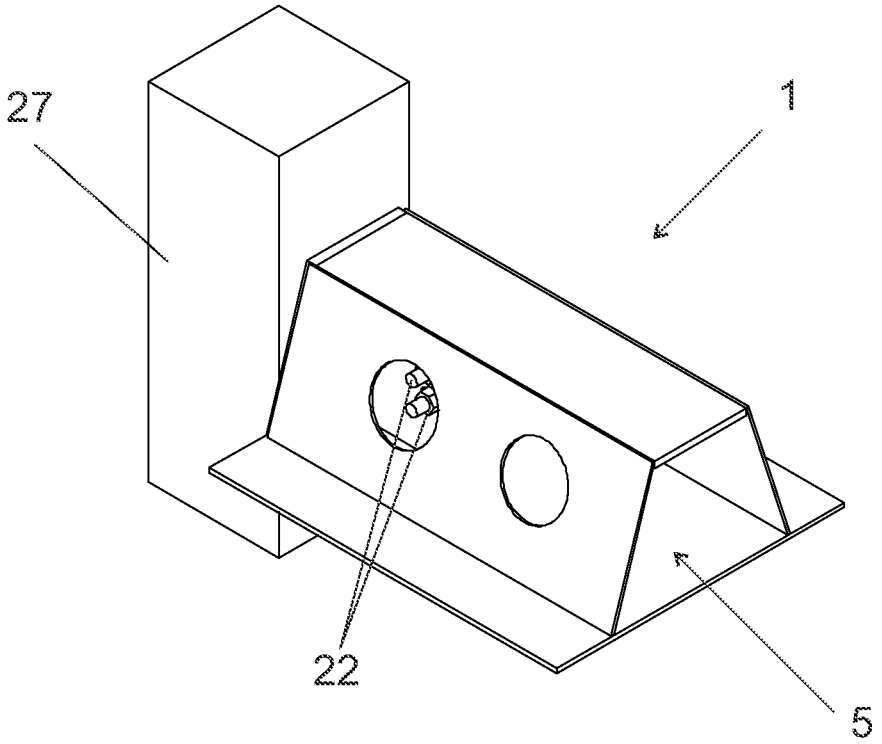
Figure 14:
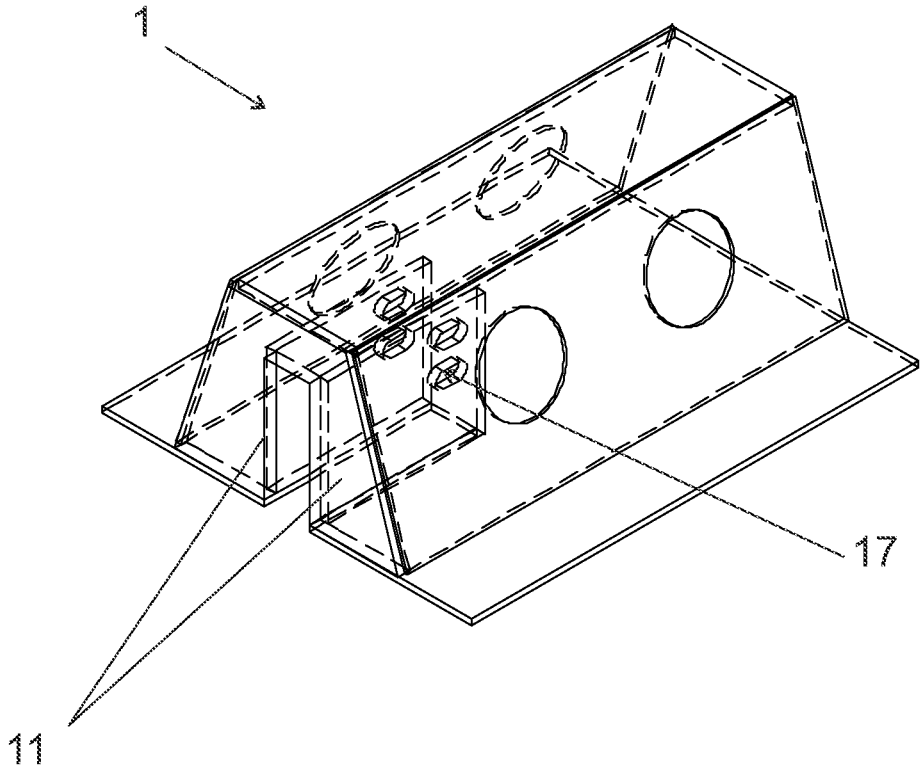
Figure 15:
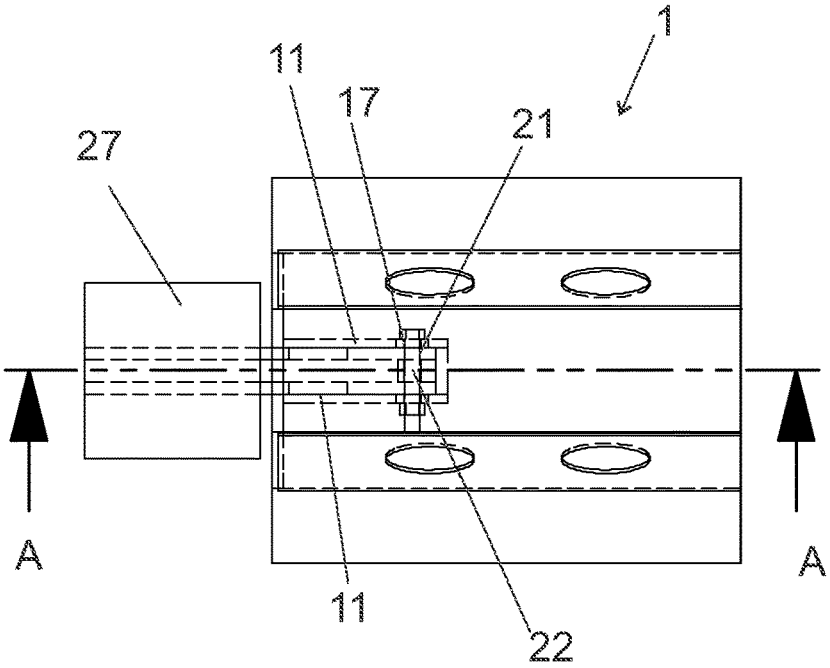
Figure 16:
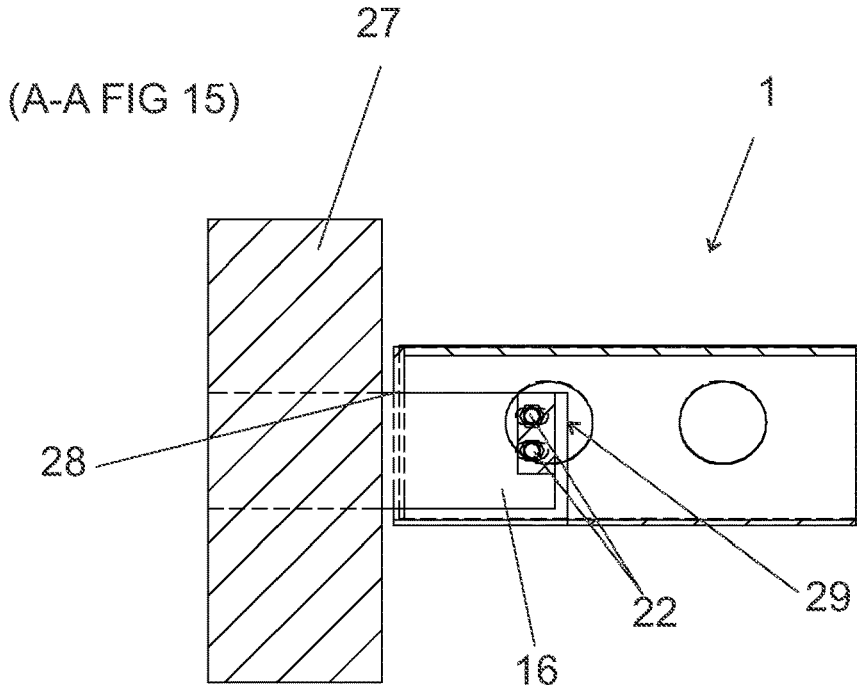
Figure 17:
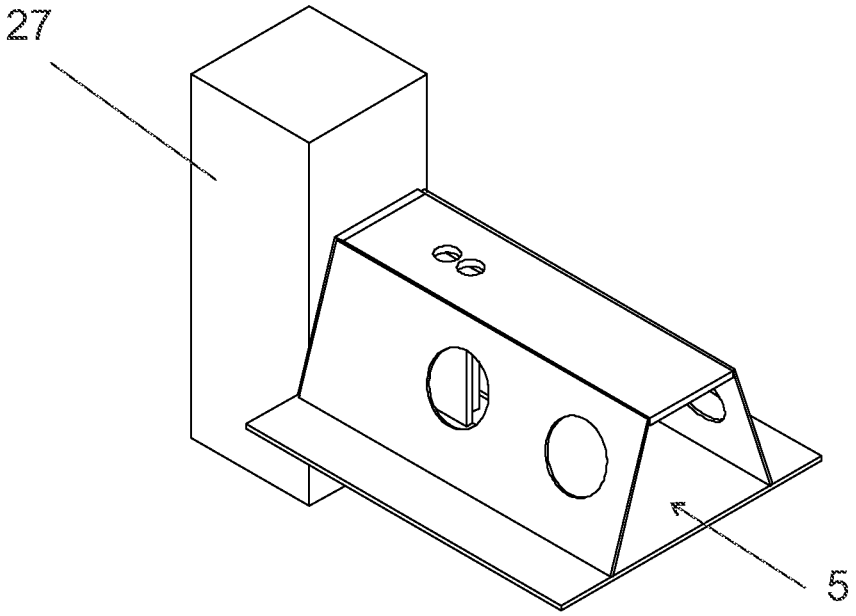
Figure 18:
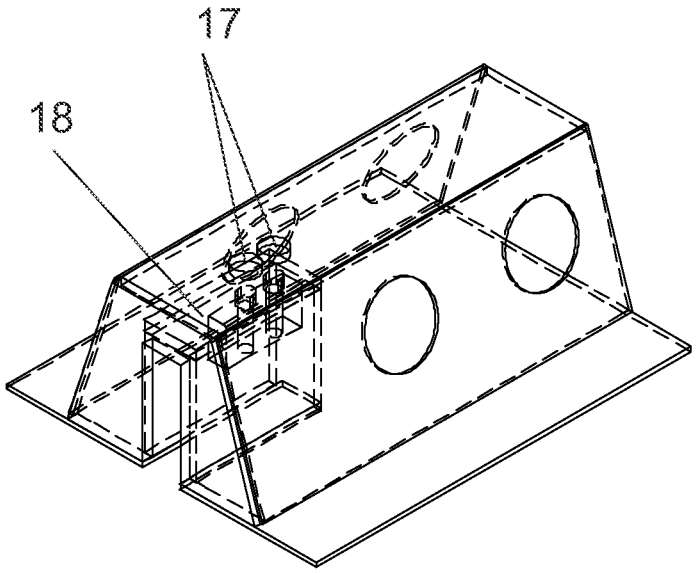
Figure 20:
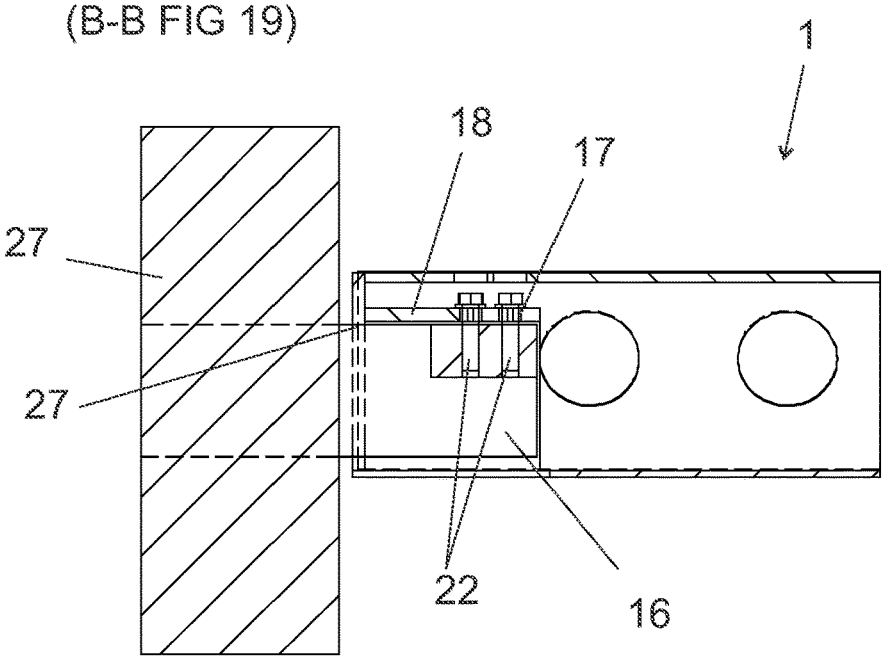
Figure 21:
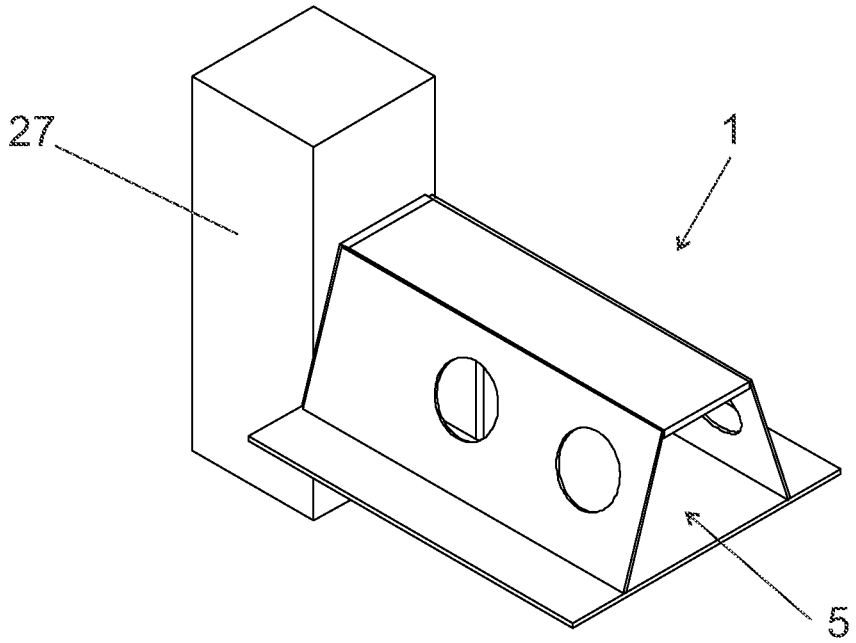
Figure 22:
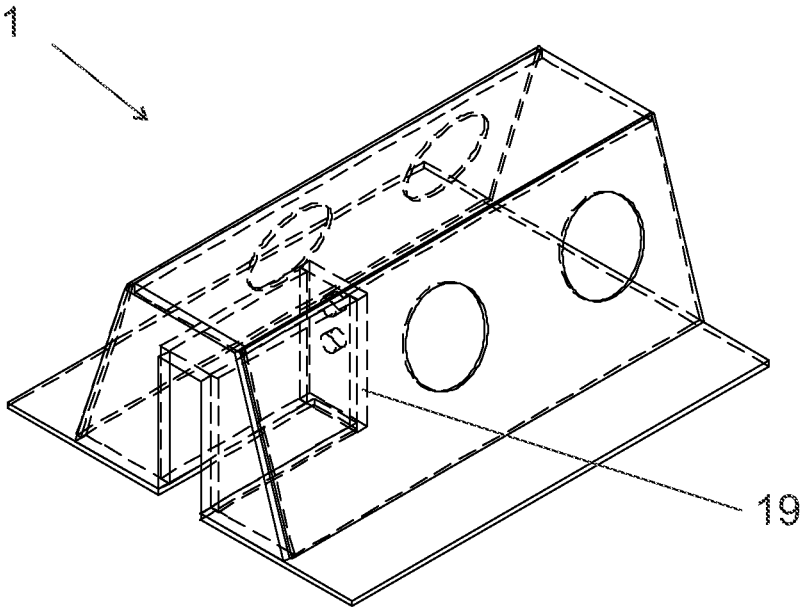
Figure 23:
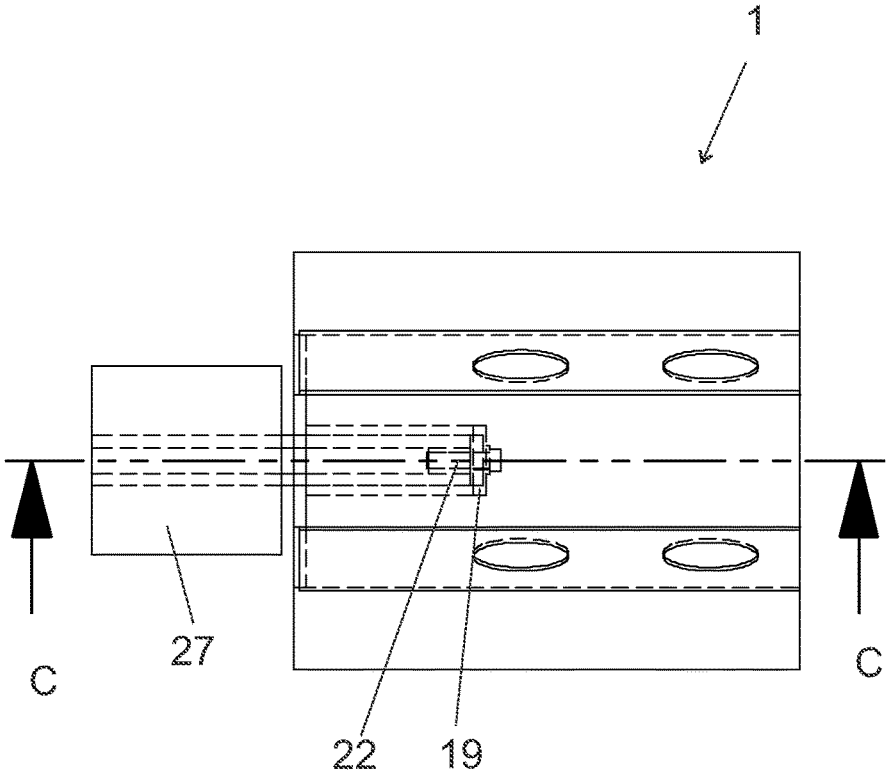
Figure 24:
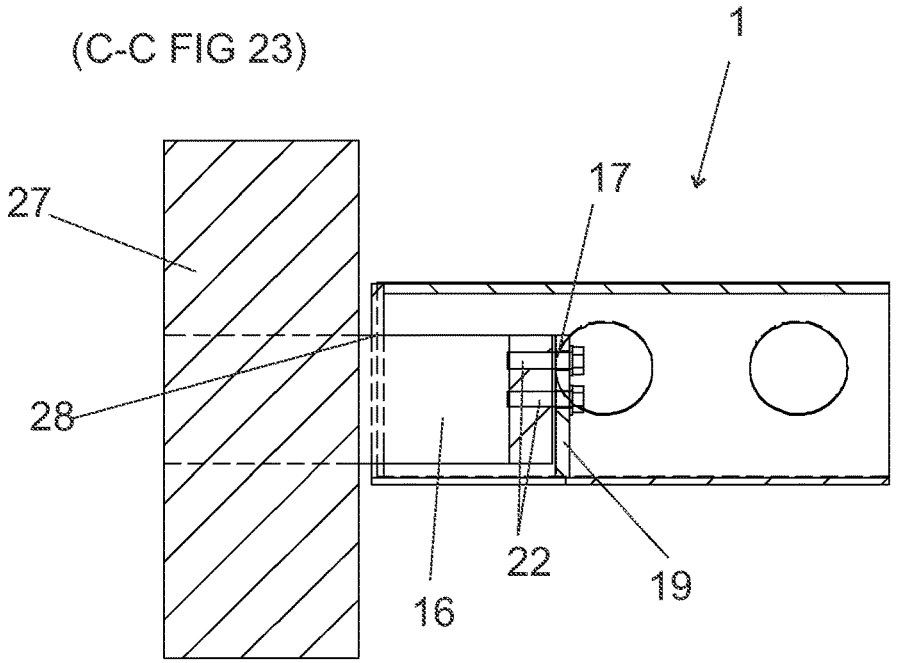
Figure 25:
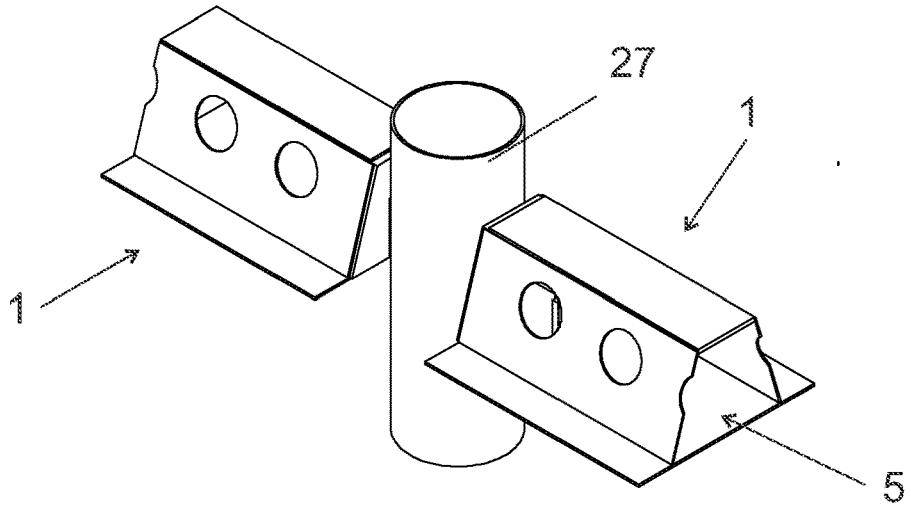
Figure 26:
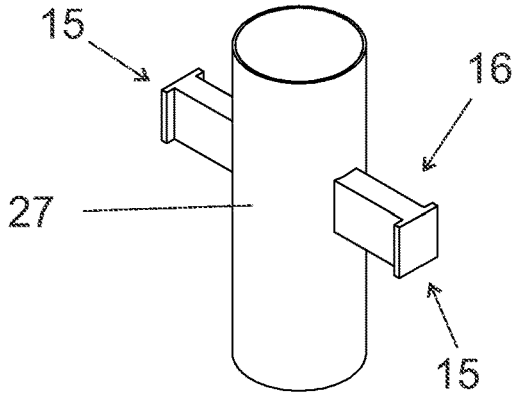
Figure 27:
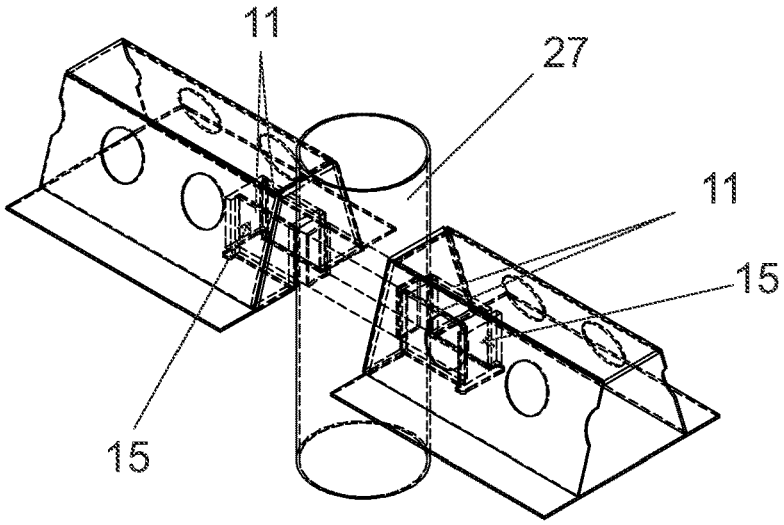
Figure 28:
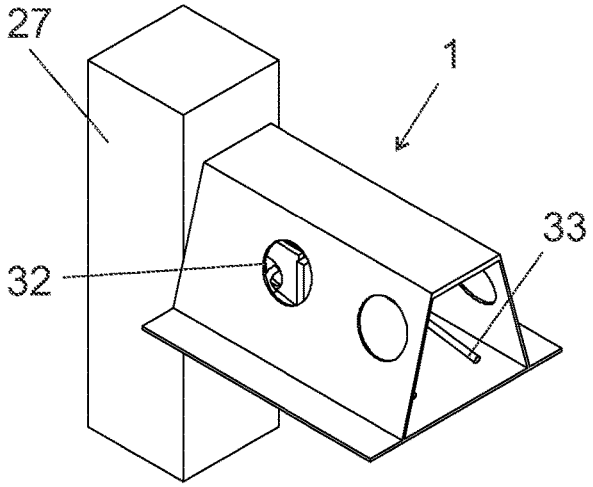
Figure 29:
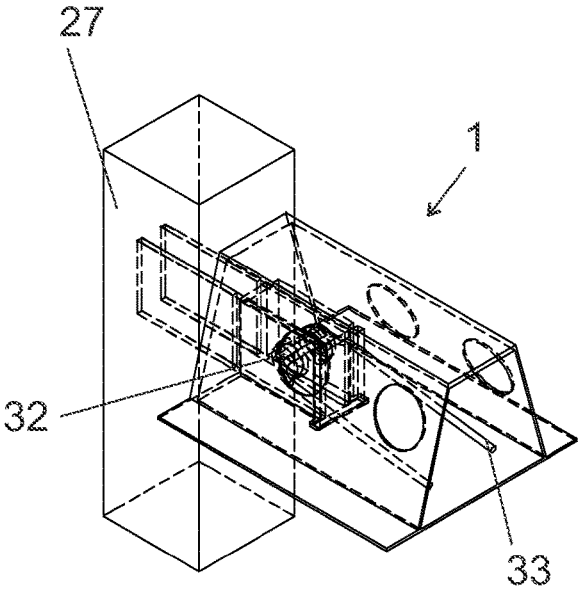
Figure 30:
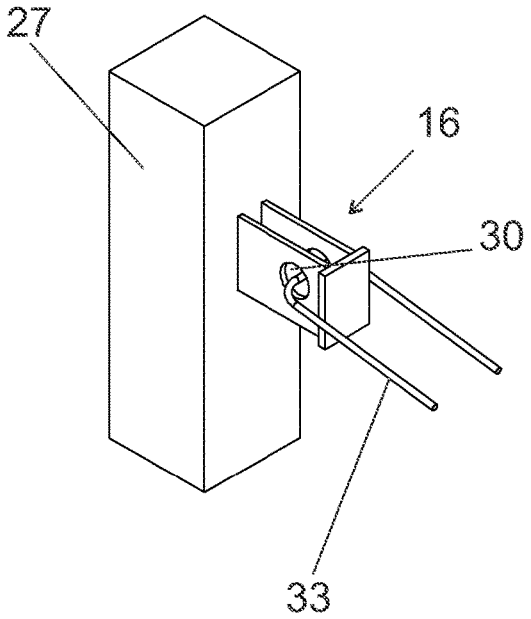
Figure 31:
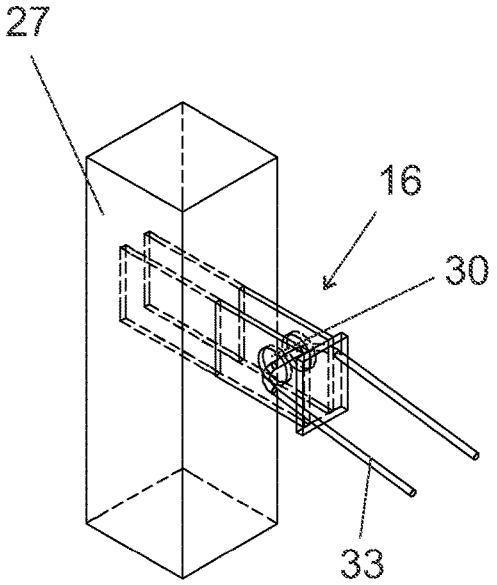
Figure 32:
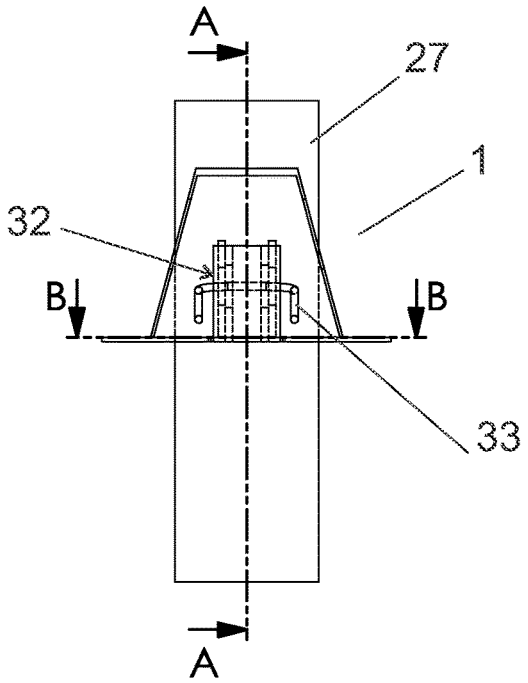
Figure 33:
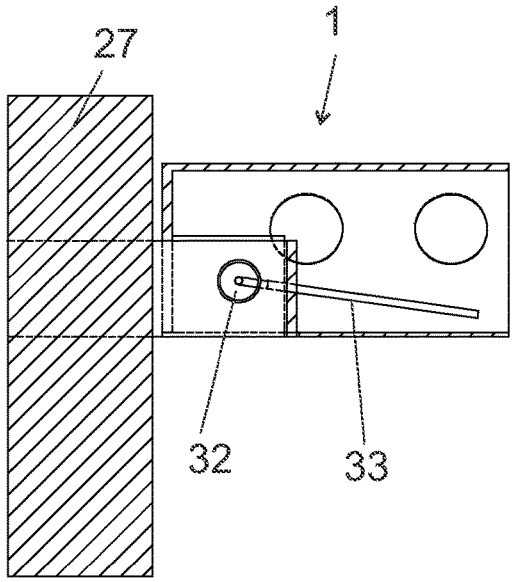
Figure 34:
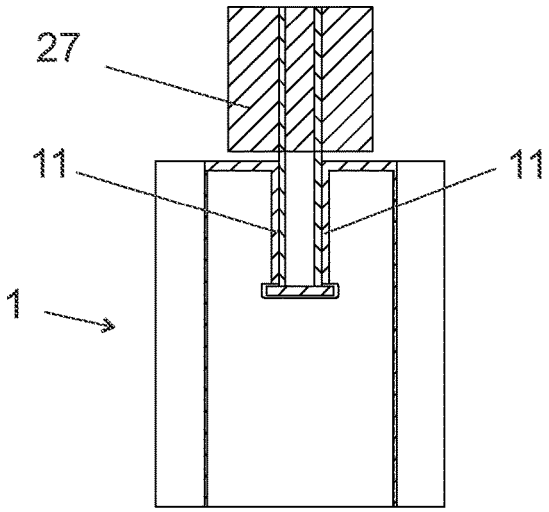
Figure 35:
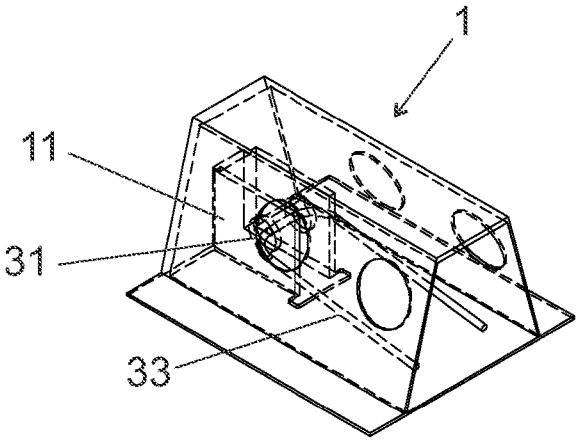
Figure 36:
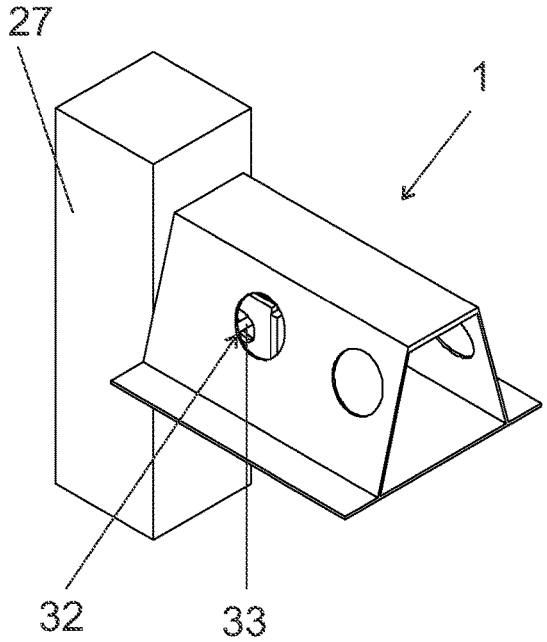
Figure 37:
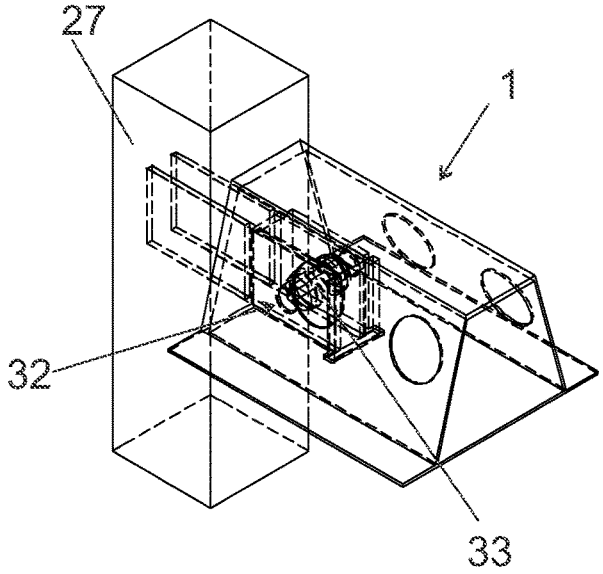
Figure 38:
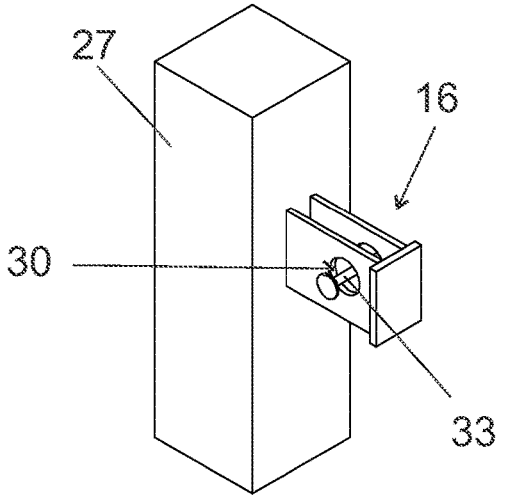
Figure 39:
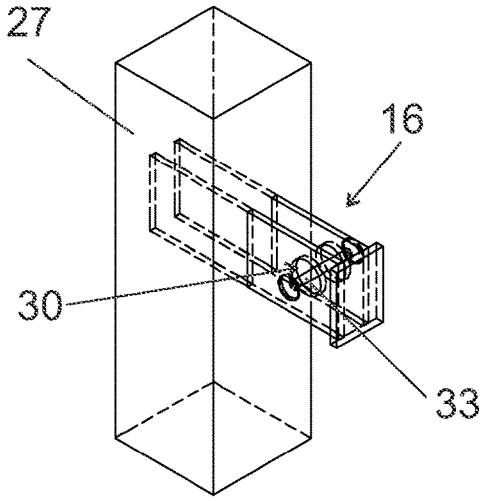
Figure 40:
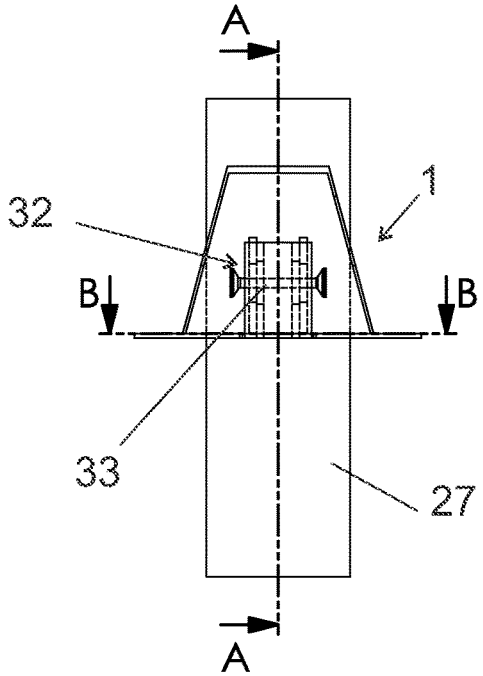
Figure 41:
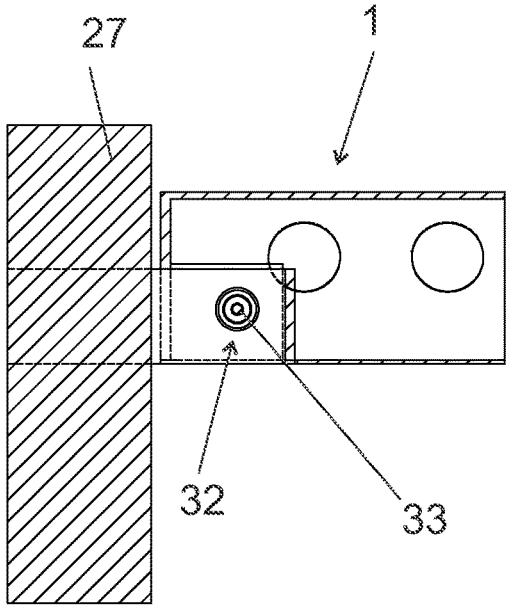
Figure 42:
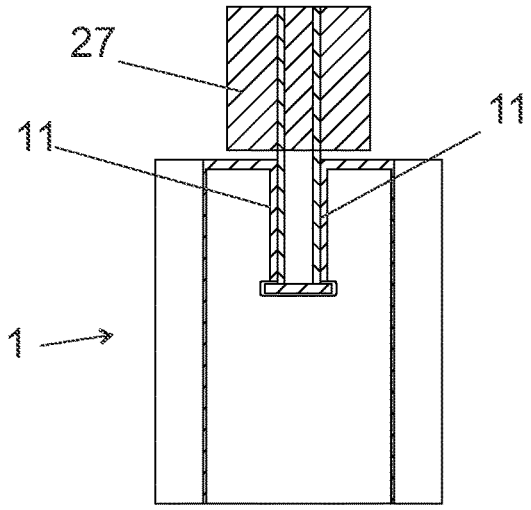
Figure 43:
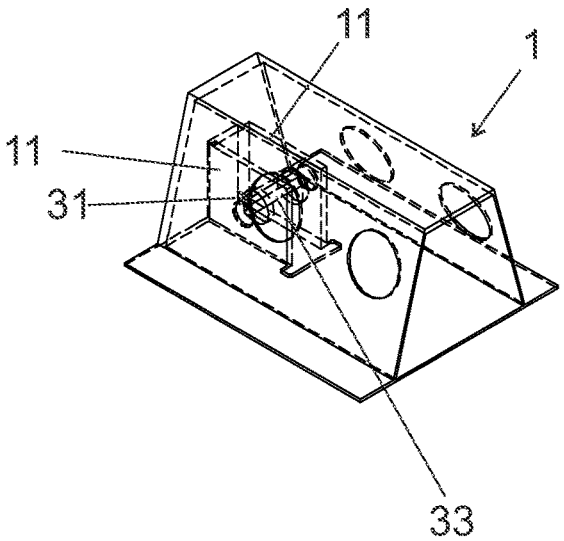

In the following the invention will described in more detail by referring to the figures, which FIGS. 1 and 2 shows a first embodiment of the steel beam, FIGS. 3 and 4 shows a second embodiment of the steel beam, FIGS. 5 and 6 shows a third embodiment of the steel beam, FIG. 7 shows a detail of the steel beam according to the first embodiment shown in FIGS. 1 and 2, FIG. 8 shows a detail of the steel beam according to the second embodiment shown in FIGS. 3 and 4 and according to the third embodiment shown in FIGS. 5 and 6, FIG. 9 shows a first embodiment of the supporting arrangement, FIG. 10 shows in partly transparent view a detail of the first embodiment the supporting arrangement shown in FIG. 9, FIG. 11 shows in partly transparent view the first embodiment the supporting arrangement shown in FIG. 9, FIG. 12 shows a detail of the first embodiment the supporting arrangement shown in FIG. 9, FIG. 13 shows a second embodiment of the supporting arrangement, FIG. 14 shows in partly transparent view a detail of the second embodiment the supporting arrangement shown in FIG. 13, FIG. 15 shows in partly transparent view the second embodiment the supporting arrangement shown in FIG. 13, FIG. 16 shows a detail of the second embodiment the supporting arrangement shown in FIG. 15 as cut along line A-A in FIG. 15, FIG. 17 shows a third embodiment of the supporting arrangement, FIG. 18 shows in partly transparent view a detail of the third embodiment the supporting arrangement shown in FIG. 17, FIG. 19 shows in partly transparent view the third embodiment the supporting arrangement shown in FIG. 17, FIG. 20 shows a detail of the third embodiment the supporting arrangement shown in FIG. 17 as cut along line B-B in FIG. 19, FIG. 21 shows a fourth embodiment of the supporting arrangement, FIG. 22 shows in partly transparent view a detail of the fourth embodiment the supporting arrangement shown in FIG. 21, FIG. 23 shows in partly transparent view the fourth embodiment the supporting arrangement shown in FIG. 21, FIG. 24 shows a detail of the fourth embodiment the supporting arrangement shown in FIG. 21 as cut along line C-C in FIG. 23, FIG. 25 shows a fifth embodiment of the supporting arrangement, FIG. 26 shows a detail of the fifth embodiment of the supporting arrangement shown in FIG. 25, FIG. 27 shows in partly transparent view the fifth embodiment of the supporting arrangement shown in FIG. 25, FIG. 28 shows a sixth embodiment of the supporting arrangement, FIG. 29 shows in partly transparent view the sixth embodiment of the supporting arrangement shown in FIG. 28, FIG. 30 shows a detail of the sixth embodiment of the supporting arrangement shown in FIG. 28, FIG. 31 shows in partly transparent view the detail of the sixth embodiment of the supporting arrangement shown in FIG. 30, FIG. 32 shows in partly transparent view the sixth embodiment of the supporting arrangement shown in FIG. 28, FIG. 33 shows in cut view the sixth embodiment of the supporting arrangement shown in FIG. 28 as cut along plane A-A in FIG. 32, FIG. 34 shows in cut view the sixth embodiment of the supporting arrangement shown in FIG. 28 as cut along plane B-B in FIG. 32, FIG. 35 shows in partly transparent view a detail of the sixth embodiment of the supporting arrangement shown in FIG. 30, FIG. 36 shows a seventh embodiment of the supporting arrangement, FIG. 37 shows in partly transparent view the seventh embodiment of the supporting arrangement shown in FIG. 36, FIG. 38 shows a detail of the seventh embodiment of the supporting arrangement shown in FIG. 36, FIG. 39 shows in partly transparent view the detail of the seventh embodiment of the supporting arrangement shown in FIG. 36, FIG. 40 shows in partly transparent view the seventh embodiment of the supporting arrangement shown in FIG. 36, FIG. 41 shows in cut view the seventh embodiment of the supporting arrangement shown in FIG. 38 as cut along plane A-A in FIG. 40, FIG. 42 shows in cut view the seventh embodiment of the supporting arrangement shown in FIG. 36 as cut along plane B-B in FIG. 40, and FIG. 43 shows in partly transparent view a detail of the seventh embodiment of the supporting arrangement shown in FIG. 36.

DETAILED DESCRIPTION

First the steel beam 1 and some embodiments and variants of the steel beam 1 will be described in greater detail.

The steel beam 1 comprises a base plate 2, two web parts 3 extending from the base plate 2, and an end plate 4 at opposite ends of the base plate 2 of the steel beam 1.

The web parts 3 can be arranged at the base plate 2 so that at least one elongated supporting surface (not marked with a reference numeral) for example for hollow core slabs is formed at the base plate 2.

The steel beam 1 can be formed by welding together a base plate 2, two web parts 3, and two end plates 4 of steel.

Is also possible that at least two of the base plate 2, the two web parts 3, and the two end plates 4 are produced from a common steel plate by bending.

The base plate 2, the two web parts 3 and the end plates 4 forms a space 5 that is at least partly limited by the base plate 2, the two web parts 3, and the two end plates 4. The space 5 can be configured to be filled with concrete (not shown in the figures). In the space 5 is configured to be filled with concrete can at least one reinforcement bar (not shown in the figures) be arranged in the space 5.

At least one of the ends of the steel beam 1 comprises a console supporting slot 6 extending from said at least one end of the steel beam 1. In the embodiments of the steel beam 1 illustrated in FIGS. 1 to 4, both ends of the steel beam 1 is provided with a console supporting slot 6 extending from each end of the steel beam 1, but it is possible that only one of the ends of the steel beam 1 is provided with a console supporting slot 6, as shown in FIGS. 5 and 6.

The console supporting slot 6 forms a first slot 7 in the end plate 4 so that the first slot 7 extend from the lower end edge 8 of the end plate 4 and a second slot 9 in the base plate 2 so that the second slot 9 extend from an end edge 10 of the base plate 2.

The console supporting slot 6 is at least partly laterally limited by side plates 11 inside the space 5 of the steel beam 1. The side plates 11 are attached for example by welding to the end plate 4 and to the base plate 2.

By utilizing the side plates 11 attached to the end plate 4 and to the base plate 2 inside the space 5, it is easy to secure the steel beam 1 to a console 16 extending into the console supporting slot 6 so that also horizontal forces can be transferred from the steel beam 1 to the console 16. The side plates 11 also makes it generally easy to secure the steel beam 1 to the console 16.

The steel beam 1 can comprise a top plate 12 that extends between the two web parts 3 and that extends between the two end plates 4. The top plate 12 can extend between the upper edges (not marked with a reference numeral) of the web parts 3, as illustrated in FIGS. 1 to 4. It is also possible that the top plate 12 is arranged on top of the web parts 3, so that the top plate 12 extend in a transversal direction of the steel beam 1 beyond the upper edge of at least one of the two web parts 3. It is also possible that top plate 12 is fastened to at least one of two web parts 3 at a distance from the upper edge of said at least one of the two web parts 3 so that said at least one of the web parts 3 has a free section (not shown in the figures) that extend beyond the top plate 12.

At least one of the two web parts 3 can comprise apertures 13 for feeding concrete (not shown in the figures) into the space 5 to form a steel-concrete-composite beam. If the space 5 is configured to be filled with concrete can at least one reinforcement bar (not shown in the figures) be arranged in the space 5.

On or both of the web parts 3 can extend perpendicularly or in an angle or in an inclined manner with respect to the base plate 2.

The end plates 4 can be arranged essentially perpendicularly to the base plate 2

The side plates 11 are preferably, but not necessarily, arranged essentially perpendicularly to the base plate 2.

The side plates 11 are preferably, but not necessarily, in the form of planar sheets of steel. The side plates 11 can be rectangular.

FIGS. 1, 2 and 7 illustrates a first embodiment of the steel beam 1. In this first embodiment of the steel beam 1, the second slot 9 in the base plate 2 comprises a widened slot section 14 that can be provided at a second closed end 25 of the second slot 9. Alternatively can the widened slot section 14 be provided at a distance from the second closed end 25 of the second slot 9. In this first embodiment of the steel beam 1, the side plates 11 extend between the end plate 4 and the widened slot section 14 of the second slot 9 so that each side plate 11 has a free plate end 26 at the widened slot section 14 of the second slot 9. The advantage of this is that this enables using console 16 having a corresponding widened console section 15 that is designed to be disposed at the widened slot section 14 so that the side plates 11 inside the space 5 of the steel beam 1 are disposed between the end plate 4 of the beam and the widened console section 15 of the console 16 so as to secure the steel beam 1 to the console 16 by means of co-operation between the widened console section 15 of the console 16 and the side plates 11 of the steel beam 1.

In this first embodiment of the steel beam 1, the second slot 9 has preferably, but not necessarily, a uniform width between the end of the steel beam 1 and the widened slot section 14 of the second slot 9.

In this first embodiment of the steel beam 1, the side plates 11 are preferably, but not necessarily identical and the side plates 11 extend preferably, but not necessarily, in parallel at opposite sides of the console supporting slot 6 inside the space 5 of the steel beam 1.

In this first embodiment of the steel beam 1, the widened slot section 14 extend preferably, but not necessarily, in two opposite directions in the base plate 2.

FIGS. 3, 4, and 8 illustrates a second embodiment of the steel beam 1 and FIGS. 5, 6 and 8 illustrates a third embodiment of the steel beam 1.

In the second and third embodiment of the steel beam 1, at least one of the side plates 11 comprises at least one first opening 17 for an external fastening means 22, for example a bolt, as illustrated in FIG. 12. In this second embodiment of the steel beam 1, the side plates 11 are preferably, but not necessarily identical and the side plates 11 extend preferably, but not necessarily, in parallel at opposite sides of the console supporting slot 6 inside the space 5 of the steel beam 1.

Alternatively or additionally can the side plates 11 in this first and third embodiment of the steel beam 1 be connected by a first top plate member 18, as illustrated in FIGS. 18 to 20, and the first top plate member 18 can comprise at least one first opening 17 for an external fastening means 22 such as a bolt.

Alternatively or additionally can the free plate ends 26 of the side plates 11 in this first embodiment of the steel beam 1 be connected by a first end plate member 19, as illustrated in FIGS. 22 to 24, and the first end plate member 19 can comprise at least one first opening 17 for an external fastening means 22, such as a bolt.

It is also possible that a steel beam 1 according to the first embodiment illustrated in FIGS. 1, 2, and 5 is provided with at least one first opening 17 for an external fastening means 22 for example in one of the side plates, in a first top plate member 16, or in an end plate member 19 as presented in connection with the second embodiment of the steel beam 1.

The side plates 11 laterally at least partly limiting the console supporting slot 6 can, as shown in connection with illustrating in FIGS. 28 to 35 a sixth embodiment of the supporting arrangement and in FIGS. 36 to 43 a seventh embodiment of the supporting arrangement, be penetrated by second through holes 31 configured to receive a reinforcement bar 33 passing through the console supporting slot 6. An advantage of this is to provide additional anchoring for the steel beam 1 at the console 16. The reinforcement bar 33 can additionally be anchored in concrete in the space 5 of the steel beam 1 if the space 5 is filled at least partly with concrete. In the sixth embodiment of the supporting arrangement the reinforcement bar 33 is bent to have essentially a U-shape and in the seventh embodiment of the supporting arrangement the reinforcement bar 33 is provided with headed ends (not marked with a reference numeral).0

Next the supporting arrangement for supporting a steel beam 1 at console 16 configured to be arranged at a support structure 27 of a building and some embodiments and variants of the supporting structure will be described in greater detail.

The steel beam 1 comprises a base plate 2, two web parts 3 extending from the base plate 2, and an end plate 4 at opposite ends of the base plate 2 of the steel beam 1.

The web parts 3 can be arranged at the base plate 2 so that at least one elongated supporting surface (not marked with a reference numeral) for example for hollow core slabs is formed at the base plate 2.

The steel beam 1 can be formed by welding together a base plate 2, two web parts 3, and two end plates 4 of steel. Is also possible that at least two of the base plate 2, two web parts 3, and two end plates 4 are produced from a common steel plate by bending.

The base plate 2, the two web parts 3 and the end plates 4 forms a space 5 that is at least partly limited by the base plate 2, the two web parts 3, and the two end plates 4. The space 5 can be configured to be filled with concrete (not shown in the figures). If the space 5 is configured to be filled with concrete can at least one reinforcement bar (not shown in the figures) be arranged in the space 5.

At least one of the ends of the steel beam 1 comprises a console supporting slot 6 extending from said at least one end of the steel beam 1. In the embodiments of the steel beam 1 illustrated in FIGS. 1 to 4, both ends of the steel beam 1 is provided with a console supporting slot 6 extending from each end of the steel beam 1, but it is possible that only one of the ends of the steel beam 1 is provided with a console supporting slot 6, as in the third embodiment of the steel beam illustrated in FIGS. 5 and 6.

The console supporting slot 6 forms a first slot 7 in the end plate 4 so that the first slot 7 extend from the lower end edge 8 of the end plate 4 and a second slot 9 in the base plate 2 so that the second slot 9 extend from an end edge 10 of the base plate 2.

The console supporting slot 6 is laterally limited by side plates 11 inside the space 5 of the steel beam 1. The side plates 11 are attached for example by welding to the end plate 4 and to the base plate 2.

The console 16 extends into the console supporting slot 6 so that a first closed end 28 of the first slot 7 in the end plate 4 of the steel beam 1 is supported on the console 16, The side plates 11 attached to the end plate 4 and to the base plate 2 are secured to the console 16 inside the space 5 of the steel beam 1.

The advantage of this is an increased ability to transfer horizontal forces from the steel beam 1 to the console 16, because the side plates 11 transfers forces from the steel beam 1 to the console 16 via the end plate 4 and the base plate 2 of the beam. Another advantage is that provision of the side plates 11 makes it possible to easily secure the steel beam 1 to the console 16 in various configurations as illustrated in FIGS. 7 to 22

The steel beam 1 can comprise a top plate 12 that extends between the two web parts 3 and that extends between the two end plates 4. The top plate 12 can extend between the upper edges (not marked with a reference numeral) of the web parts 3, as illustrated in FIGS. 1 to 4. It is also possible that the top plate 12 is arranged on top of the web parts 3, so that the top plate 12 extend in a transversal direction of the steel beam 1 beyond the upper edge of at least one of the web parts 3. It is also possible that top plate 12 is fastened to at least one of two web parts 3 at a distance from the upper edge of said at least one of the two web parts 3 so that said at least one of the web parts 3 has a free section (not shown in the figures) that extend beyond the top plate 12.

At least one of the two web parts 3 can comprise apertures 13 for feeding concrete (not shown in the figures) into the space 5 to form a steel-concrete-composite beam.

On or both of the web parts 3 can extend perpendicularly or in an angle with respect to the base plate 2.

The end plates 4 can be arranged essentially perpendicularly to the base plate 2

The side plates 11 are preferably, but not necessarily, arranged essentially perpendicularly to the base plate 2.

The side plates 11 are preferably, but not necessarily, in the form of planar sheets of steel. The side plates 11 can be rectangular.

The side plates 11 are preferably, but not necessarily identical and the side plates 11 extend preferably, but not necessarily, in parallel at opposite sides of the console supporting slot 6 inside the space 5 of the steel beam 1.

FIGS. 9 to 12 illustrates a first embodiment of the supporting arrangement. In this first embodiment of the steel beam 1, the second slot 9 in the base plate 2 comprises a widened slot section 14 that can be provided at a second closed end 25 of the second slot 9 in the base plate 2 of the steel beam 1 as shown in FIGS. 9 to 12. Alternatively can the widened slot section 14 be provided at a distance from the second closed end 25 of the second slot 9 in the base plate 2 of the steel beam. In this first embodiment of the supporting arrangement, the side plates 11 extend between the end plate 4 and the widened slot section 14 of the second slot 9 in the base plate 2 of the steel beam 1 so that each side plate 11 has a free plate end 26 at the widened slot section 14 of the second slot 9. In this first embodiment of the supporting arrangement, the console 16 has a widened console section 15, which may, as illustrated in FIGS. 9 to 12, be provided at a free console end 29 of the console 16, and the console 16 extend into the console supporting slot 6 so that the side plates 11 being disposed between the end plate 4 of the beam and the widened console section 15. One result of this is that the steel beam 1 will be secured against longitudinal movement with respect to the console 16 because the side plates 11 inside the space 5 of the steel beam 1 and the end plate 4 of the steel beam 1 are disposed between the support structure 27 and the widened console section 15 of the console.

In this first embodiment of the supporting arrangement, the second slot 9 in the base plate 2 of the beam has preferably, but not necessarily, a uniform width between the end of the steel beam 1 and the widened slot section 14 of the second slot 9.

In this first embodiment of the supporting arrangement, the widened slot section 14 extends preferably, but not necessarily, in two opposite directions in the base plate 2 of the steel beam 1.

In this first embodiment of the supporting arrangement, the console 16 has preferably, but not necessarily, a uniform width between the end plate 4 of the steel beam 1 and the widened console section 15.

In this first embodiment of the supporting arrangement, the widened console section 15 of the console 16 is preferably, but not necessarily, in contact with the free plate end 26 of each side plate 11.

In this first embodiment of the supporting arrangement, the widened console section 15 can be formed by a plate means 20 provided and fastened at the free console end 29 of the console 16.

FIGS. 13 to 15 illustrates a second embodiment of the supporting arrangement. In this second embodiment of the supporting arrangement, at least one of the side plates 11 comprises at least one first opening 17 for external fastening means 22 and the console 16 comprises at least one second opening 21 for external fastening means 22. In this second embodiment of the supporting arrangement, said at least one first opening 17 in said at least one of the side plates 11 and said at least one second opening 21 in the console 16 are aligned and an external fastening means 22 passing through said at least one first opening 17 in said at least one of the side plates 11 and said at least one second opening 21 in the console 16.

If the web parts 3 are provided with apertures 13, as illustrated in FIGS. 13 to 16, the first openings 17 in the side plates 11 are preferably, not necessarily, aligned with apertures 13 in the web parts 3 to make it possible to use the apertures 13 in the fastening of the steel beam 1 to the console 16.

FIGS. 17 to 20 illustrates a third embodiment of the supporting arrangement. In this third embodiment of the supporting arrangement, a first top plate member 18 connecting the side plates 11 is provided and at least one first opening 17 is provided in the first top plate member 18. This third embodiment of the supporting arrangement comprises at least one second opening 21 in the console 16. Said at least one second opening 21 in the console 16 can be provided in a second top plate member 23 of the console as illustrated in FIGS. 17 to 20, which second top plate member 23 connecting two parallel console plates 31 of the console 16. In this third embodiment of the supporting arrangement, said at least one first opening 17 in the first top plate member 18 and said at least one second opening 21 in the console 16 are aligned and an external fastening means 22, which in this embodiment is vertical, passes through said at least one first opening 17 in the first top plate member 18 and said at least one second opening 21 in the second top plate member 23. The external fastening means 22 can in this embodiment of the supporting arrangement comprise bolts as illustrated in FIGS. 17 to 20.

FIGS. 21 to 24 illustrates a fourth embodiment of the supporting arrangement. In this third embodiment of the supporting arrangement, a first end plate member 19 connecting the free plate ends 26 of the side plates 11 and least one first opening 17 is provided in the first end plate member 19. This third embodiment of the supporting arrangement comprises at least one second opening 21 in the console 16. Said at least one second opening 21 in the console 16 can be provided in a second end plate member 24 of the console as illustrated in FIGS. 21 to 24, which second end plate member 24 connecting the free ends two parallel console plates 31 of the console 16. In this third embodiment of the supporting arrangement, said at least one first opening 17 in the first end plate member 26 and said least one second opening 21 in the console 16 are aligned and an external fastening means 22, which in this embodiment is essentially horizontal, passes through said at least one first opening 17 in the first end plate member 19 and said least one second opening 21 in the console 16.

The first openings 17 in the side plates 11 and/or the second openings 21 in the console 21 can be elongated slots so as to make it easier to align the first openings 17 in the side plates 11 and the second openings 21 in the console 21.

In the second, third and fourth embodiment of the supporting arrangement, the second slot 9 in the base plate of the beam has preferably, but not necessarily, a uniform width between the end of the steel beam 1 and the second closed end 25 of the second slot 9.

In this second, third and fourth embodiment of the supporting arrangement, the console 16 has preferably, but not necessarily, a uniform width between the end plate 4 of the steel beam 1 and the free console end 29 of the console 16.

In this second, third and fourth embodiment of the supporting arrangement, the width of the console supporting slot 6 corresponds preferably, but not necessarily, to the width of the console 16.

In this second, third and fourth embodiment of the supporting arrangement, the distance between the side plates 11 corresponds preferably, but not necessarily, to the width of the console 16.

FIGS. 25 to 27 shows a fifth embodiment of the supporting arrangement. This fifth embodiment of the supporting arrangement corresponds essentially to the first embodiment of the supporting arrangement illustrated in FIGS. 9 to 12 with the exception that the console 16 extends through the supporting structure 27, which in FIGS. 25 to 27 is column, so that a steel beam 1 can be supported on two opposite sides of the supporting structure 27. In the same way as is illustrated in FIGS. 25 to 27 can the second embodiment of the supporting arrangement illustrated in FIGS. 13 to 16, the third embodiment of the supporting arrangement illustrated in FIGS. 17 to 20, and the third embodiment of the supporting arrangement illustrated in FIGS. 21 to 24 be modified so that the console extends through the supporting structure 27

FIGS. 28 to 35 shows a sixth embodiment of the supporting arrangement and FIGS. 36 to 43 shows a seventh embodiment of the supporting arrangement. In the sixth and in the seventh embodiment of the supporting arrangement, the console 16 is penetrated by at least one first trough hole 30, each of the side plates 11 is penetrated by at least one second through hole 31, and said at least one first through hole 30 in the console 16 and at least one second through hole 31 in each side plate 11 are aligned to form a passage 32 for a reinforcement bar 33 arranged in the passage 32. An advantage of this is to provide additional anchoring for the steel beam 1 at the console 16. The reinforcement bar 33 can additionally be anchored in concrete in the space 5 of the steel beam 1 if the space 5 is filled at least partly with concrete. In the sixth embodiment the reinforcement bar 33 is bent to have essentially a U-shape and in the seventh embodiment the reinforcement bar 33 is provided with headed ends (not marked with a reference numeral).

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A steel beam comprising a base plate, two web parts extending from the base plate, and an end plate at each end of the steel beam, wherein the base plate, the two web parts and the end plates delimit a space, and wherein at least one of the ends of the steel beam comprising a console supporting slot extending from the at least one end of the steel beam, wherein the console supporting slot forms a first slot in the end plate and a second slot in the base plate, wherein the console supporting slot being laterally at least partly limited by side plates inside the space of the steel beam, and by the side plates being attached to the end plate and to the base plate.

2. The steel beam according to claim 1, wherein the steel beam comprising a top plate that extends between the two web parts and that extends between the two end plates.

3. The steel beam according to claim 1, wherein at least one of the two web parts comprises apertures for feeding concrete into the space.

4. The steel beam according to claim 1, wherein the side plates are parallel, and by one side plate at each side of the console supporting slot and by the side plates having essentially identical dimensions and form.

5. The steel beam according to claim 1, wherein the second slot in the base plate comprising a widened slot section, and by the side plates extending between the end plate and the widened slot section of the second slot so that each side plate has a free plate end at the widened slot section of the second slot.

6. The steel beam according to claim 5, wherein the second slot having a uniform width between the end of the steel beam and the widened slot section of the second slot.

7. The steel beam according to claim 5, wherein the widened slot section extending in two opposite directions in the base plate of the steel beam.

8. The steel beam according to claim 1, wherein at least one of the side plates comprises at least one first opening for an external fastening means.

9. The steel beam according to claim 1, wherein the side plates being connected by a first top plate member, and by the first top plate member comprises at least one first opening for an external fastening means.

10. The steel beam according to claim 5, wherein the free plate ends of the side plates being connected by a first end plate member, and by the first end plate member comprises at least one first opening for an external fastening means.

11. The steel beam according to claim 1, wherein the side plates laterally at least partly limiting the console supporting slot being penetrated by through holes configured to receive a reinforcement bar passing through the console supporting slot.

12. A supporting arrangement for supporting a steel beam at console configured to be arranged at a support structure of a building, wherein the steel beam comprising a base plate, two web parts extending from the base plate, and an end plate at each end of the steel beam, wherein the base plate, the two web parts and the end plates delimits a space, wherein at least one of the ends of the steel beam comprising a console supporting slot extending from the at least one end of the steel beam, wherein the console supporting slot forms a first slot in the end plate and a second slot in the base plate, and wherein the console extending into the console supporting slot so that a first closed end of the first slot in the end plate of the steel beam is supported on the console, wherein the console supporting slot being at least partly laterally limited by side plates inside the space of the steel beam, and by the side plates being attached to the end plate and to the base plate.

13. The supporting arrangement according to claim 12, wherein the second slot in the base plate comprising a widened slot section, by the side plates extending between the end plate and the widened slot section of the second slot in the base plate of the steel beam so that each side plate has a free plate end at the widened slot section of the second slot, by the console having a widened console section, and by the console extending into the console supporting slot so that the side plates being disposed between the end plate of the steel beam and the widened console section of the console.

14. The supporting arrangement according to claim 13, wherein the second slot in the base plate of the steel beam having a uniform width between the end of the steel beam and the widened slot section of the second slot.

15. The supporting arrangement according to claim 13, wherein the widened slot section extending in two opposite directions in the base plate of the steel beam.

16. The supporting arrangement according to claim 13, wherein—the console having uniform width between the end plate of the steel beam and the widened console section of the console.

17. The supporting arrangement according to claim 13, wherein the widened console section of the console being in contact with the free plate end of each side plate.

18. The supporting arrangement according to claim 13, wherein the widened console section being formed by a plate means provided at the free console end of the console.

19. The supporting arrangement according to claim 12, wherein at least one of the side plates comprises at least one first opening for external fastening means, by the console comprises at least one second opening for external fastening means, and by the at least one first opening in the at least one of the side plates and the at least one second opening in the console being aligned and by an external fastening means passing through the at least one first opening in the at least one of the side plates and the at least one second opening in the console.

20. The supporting arrangement according to claim 12, wherein a first end plate member connecting the free plate ends of the side plates by at least one first opening in the first end plate member, by the console comprises at least one second opening for external fastening means, and by the at least one first opening in the first end plate member and the least one second opening in the console being aligned and an external fastening means passing through the at least one first opening in the first end plate member and the least one second opening in the console.

21. The supporting arrangement according to claim 12, wherein a first top plate member connecting the side plates, by at least one first opening in the first top plate member, by the console comprises at least one second opening for external fastening means, and by the at least one first opening in the first top plate member and the at least one second opening in the console being aligned and by an external fastening means passing through the at least one first opening in the first top plate member and the at least one second opening in the console.

22. The supporting arrangement according to claim 19, wherein the second slot in the base plate of the steel beam having a uniform width between the end of the steel beam and a second closed end of the second slot.

23. The supporting arrangement according to claim 19, wherein the console having uniform width between the end plate of the steel beam and the free console end of the console.

24. The supporting arrangement according to claim 19, wherein the width of the console supporting slot corresponding to the width of the console.

25. The supporting arrangement according to claim 12, wherein the console being penetrated by at least one first trough hole, by each of the side plates being penetrated by at least one second through hole, and by the at least one first through hole in the console and at least one second through hole in each side plate being aligned to form a passage for a reinforcement bar arranged in the passage.

* * * * *